US008061985B2

(12) United States Patent
Taguchi et al.

(10) Patent No.: US 8,061,985 B2
(45) Date of Patent: Nov. 22, 2011

(54) CEILING-EMBEDDED VENTILATION FAN

(75) Inventors: Masashi Taguchi, Aichi (JP); Takayoshi Matsumoto, Aichi (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/057,026

(22) PCT Filed: Mar. 12, 2010

(86) PCT No.: PCT/JP2010/001783

§ 371 (c)(1),
(2), (4) Date: Feb. 1, 2011

(87) PCT Pub. No.: WO2010/125735

PCT Pub. Date: Nov. 4, 2010

(65) Prior Publication Data

US 2011/0117831 A1 May 19, 2011

(30) Foreign Application Priority Data

Apr. 30, 2009 (JP) ..... 2009-110554

(51) Int. Cl.
*F04D 29/00* (2006.01)

(52) U.S. Cl. ..... 415/232

(58) Field of Classification Search ..... 415/70, 415/119, 203, 204, 206, 213.1, 232; 416/148, 416/178, 187, 198 R, 198 A, 241 R, 244 R, 416/246, 248

See application file for complete search history.

(56) References Cited

U.S. PATENT DOCUMENTS 3,201,032 A * 8/1965 Gelbard ..... 416/175
6,711,015 B2 * 3/2004 Syring et al. ..... 361/695

FOREIGN PATENT DOCUMENTS

| | | |
|---|---|---|
| JP | 61-60039 | 4/1986 |
| JP | 3-72245 | 7/1991 |
| JP | 9-26179 | 1/1997 |
| JP | 2003-065581 | 3/2003 |

OTHER PUBLICATIONS

International Search Report of PCT Application No. PCT/JP2010/001783, dated on Jun. 15, 2010.

* cited by examiner

*Primary Examiner* — Edward Look
*Assistant Examiner* — Aaron R Eastman
(74) *Attorney, Agent, or Firm* — Panasonic Patent Center; Dhiren Odedra; Kerry Culpepper

(57) ABSTRACT

A ceiling-embedded ventilation fan includes: a casing provided in a box-shape frame inserted and mounted in a ceiling and having an opening facing an indoor side in a lower face thereof, the casing having a side face formed in a scroll shape and set in a vertical direction, the casing further having a casing intake port in the lower face of the frame and a casing discharge port in a side portion of the frame; a centrifugal blower blade housed in the casing and having a blade intake port facing the casing intake port; and an electric motor which rotates the centrifugal blower blade, wherein the centrifugal blower blade is provided so that an upper side of an axial center thereof is tilted in a direction toward an upstream side of a centrifugal airflow based on a center line of the casing intake port in a direction orthogonal to the casing discharge port.

9 Claims, 8 Drawing Sheets

CEILING-EMBEDDED VENTILATION FAN

TECHNICAL FIELD

The present invention relates to a ceiling-embedded ventilation fan.

BACKGROUND ART

Patent Document 1 discloses a conventional ceiling-embedded ventilation fan, wherein the fan is connected to a duct placed in a ceiling to communicate with an outdoor environment and is mounted in an embedded manner in the ceiling. FIG. 9 is a sectional view of the ceiling-embedded ventilation fan mounted in the ceiling.

As illustrated in FIG. 9, the ceiling-embedded ventilation fan has frame 104 having a box shape, adapter 106, casing 108, centrifugal blower blade 109, and electric motor 110. Box-shape frame 104 is provided with intake port 102 covered with grille 101 formed in a lower face thereof, and discharge port 103 formed in a side face thereof. Duct 105, which communicates with the outdoor environment, is connected to adapter 106. Casing 108 has a scroll shape having orifice 107 used as an intake port in an interior lower face of frame 104. Centrifugal blower blade 109 is housed in casing 108 to blow air. Electric motor 110 rotates centrifugal blower blade 109.

The conventional ceiling-embedded ventilation fan having the above configuration involves a larger resistance loss, reducing an airflow in the event that some parts of duct 105 are inflected when placed in the ceiling or duct 105 is longer than expected. When using the ceiling-embedded ventilation fan under such an increased resistance loss resulting in a large static pressure, a product specification focusing on the intensity of airflow makes it necessary to increase the outer circumferential speed of an impeller provided in centrifugal blower blade 109. To increase the outer circumferential speed, it becomes necessary to increase the number of rotations of electric motor 110, thus problematically increasing a noise value.

The product specification focusing on the intensity of airflow when the static pressure is high leads to another problem that there is less airflow when the static pressure is low.

PRIOR ART DOCUMENT

Patent Document

[Patent Document 1] Unexamined Japanese Patent Publication No. 2003-65581

DISCLOSURE OF THE INVENTION

A ceiling-embedded ventilation fan according to the present invention includes: a casing provided in a box-shape frame inserted and mounted in a ceiling and having an opening facing an indoor side in a lower face thereof, the casing having a side face formed in a scroll shape and set in a vertical direction, the casing further having a casing intake port in the lower face of the frame and a casing discharge port in a side portion of the frame; a centrifugal blower blade housed in the casing and having a blade intake port facing the casing intake port; and an electric motor which rotates the centrifugal blower blade, wherein the centrifugal blower blade is provided so that an upper side of an axial center thereof is tilted in a direction toward an upstream side of a centrifugal airflow based on a center line of the casing intake port in a direction orthogonal to the casing discharge port.

In the ceiling-embedded ventilation fan having the above configuration, an enlargement ratio of an air course width increases from the side of the blade intake port toward the opposite side of the blade intake port in an inner peripheral region of the casing. This improves the ventilation capability when the static pressure is high on the opposite side of the blade intake port where the ventilation capability is not as good as the other side when the static pressure is high, consequently improving the ventilation capability throughout the blade. As a result, a required airflow can be reliably obtained when the fan is used in a wide range of static pressure levels from low to high, and the noise value is prevented from elevating. The enlargement ratio of the air course width as used herein refers to an increase ratio of a distance from a circumferential side face of the centrifugal blower blade on the discharge side to an inner peripheral side face of the casing.

PREFERRED EMBODIMENTS FOR CARRYING OUT OF THE INVENTION

Hereinafter, embodiments of the present invention are described referring to the accompanying drawings.

Embodiment 1

Figure 1:
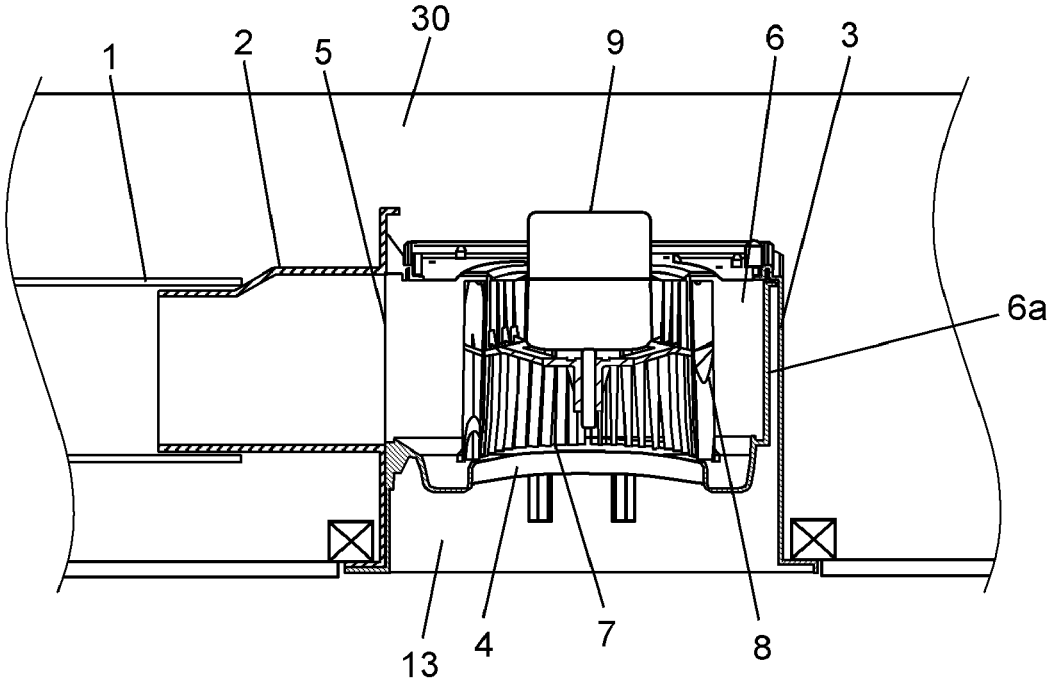
FIG. 1 is a sectional view of a ceiling-embedded ventilation fan according to Embodiment 1 of the present invention mounted in a ceiling.

FIG. 1 is a sectional view of a ceiling-embedded ventilation fan according to Embodiment 1 of the present invention mounted in a ceiling. As illustrated in FIG. 1, the ceiling-embedded ventilation fan has casing 6, centrifugal blower blade 8, and electric motor 9 which are housed in frame 3. Frame 3 is inserted and mounted in ceiling 30. Frame 3 is formed in a box shape and has adapter 2 and opening 13. Adapter 2 is connected to duct 1, which communicates with an outdoor environment, in a side portion of frame 3. Opening 13 is facing an indoor side in a lower face of frame 3. Casing 6 has casing intake port 4 provided in the lower face of frame 3, casing discharge port 5 provided in the side portion of frame 3, and side face **6*a* having a scroll shape. Centrifugal blower blade 8 is housed in casing 6. Centrifugal blower blade 8 has blade intake port 7 facing casing intake port 4. Electric motor 9 rotates centrifugal blower blade 8. Casing 6 is arranged so that scroll-shaped side face 6***a* is set in a vertical direction.

Figure 2:
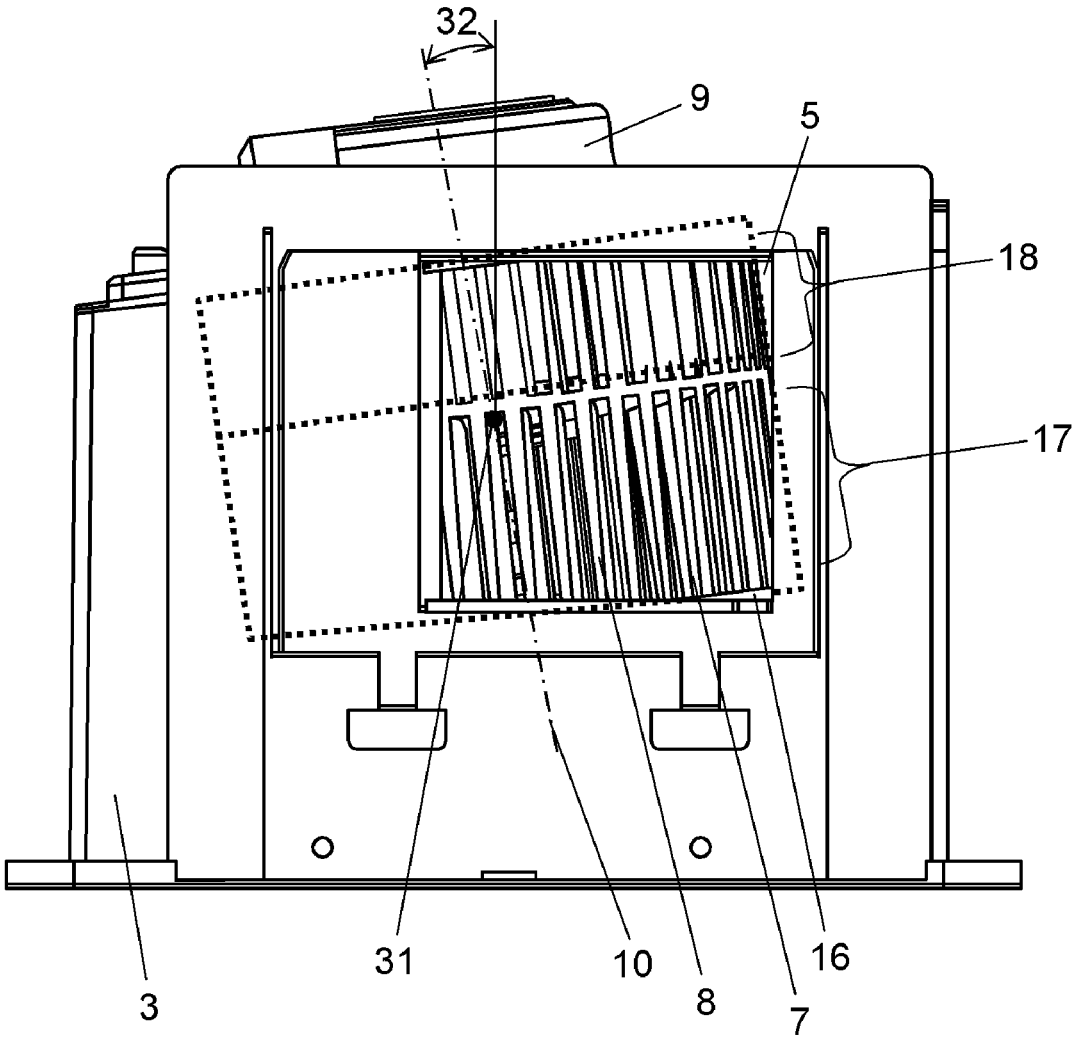
FIG. 2 is a side view of the ceiling-embedded ventilation fan viewed from the side of a casing discharge port.
Figure 3:
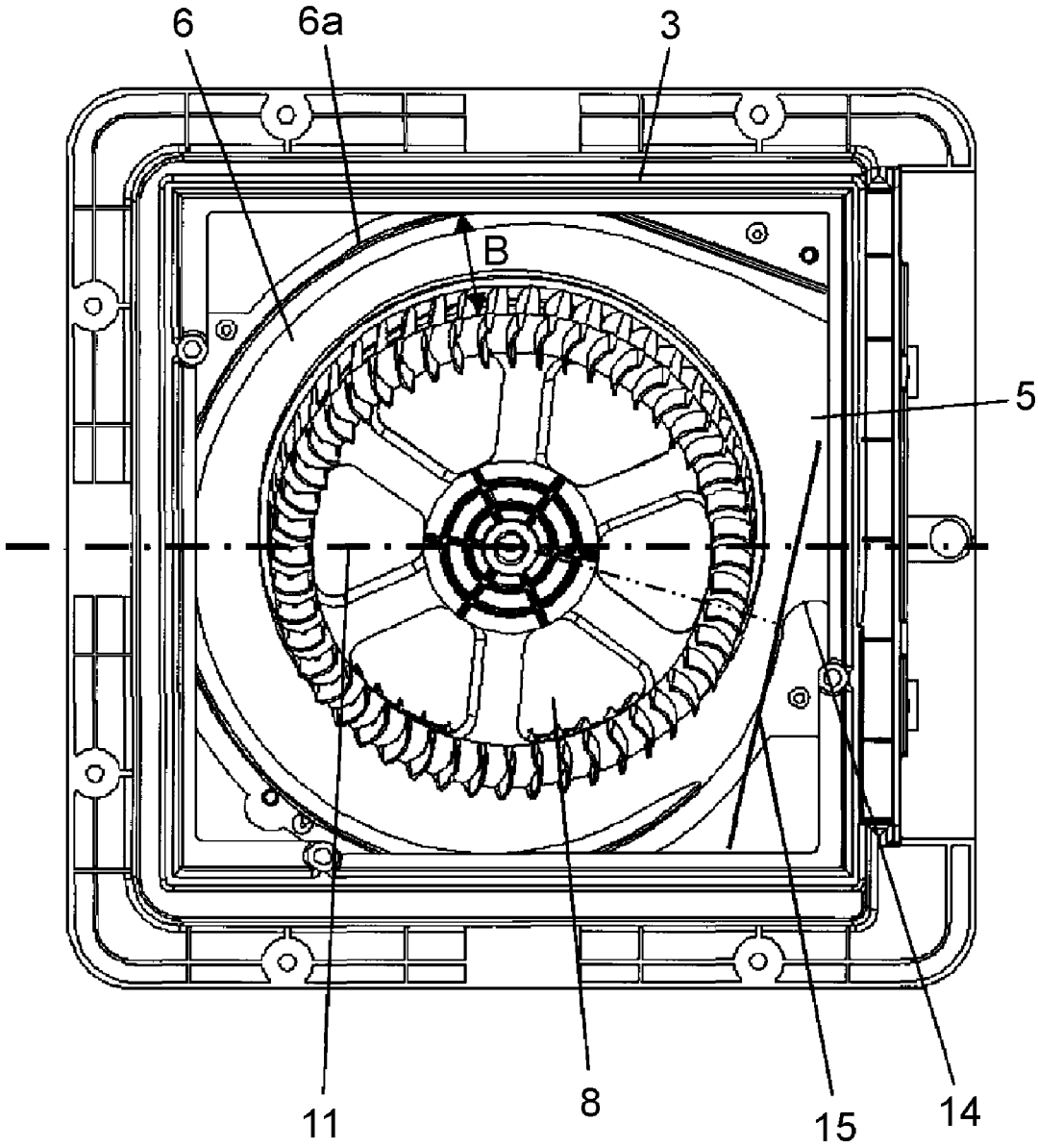
FIG. 3 is a bottom view of the ceiling-embedded ventilation fan, revealing the interior of a frame.

FIG. 2 is a side view of the ceiling-embedded ventilation fan according to Embodiment 1 viewed from the side of the casing discharge port. FIG. 3 is a bottom view of the ceiling-embedded ventilation fan, revealing the interior of the frame. Centrifugal blower blade 8 is disposed so that an upper side of axial center 10 thereof is tilted in a direction toward an upstream side of a centrifugal airflow based on center line 11 of casing intake port 4 in a direction orthogonal to casing discharge port 5.

The formation of side face 6*a* of casing 6 in the scroll shape starts with one end thereof on the side of tongue portion 14 and then ends with the other end in the flow direction of the centrifugal airflow generated by centrifugal blower blade 8. Accordingly, centrifugal blower blade 8 is disposed so that the upper side thereof is tilted in a direction distant from the scroll-end side based on center line 11.

As a result of the tilt, a center point in a longitudinal length of centrifugal blower blade 8 in axial center 10 is base point 31 of the tilt. More specifically, an upper side from base point 31 in axial center 10 is tilted in a direction toward an upstream side of the centrifugal airflow based on center line 11, whereas a lower side from base point 31 is tilted in a direction toward a downstream side thereof.

The upstream side of the centrifugal airflow is lower than center line 11 in FIG. 3, where there is a large intake of air coming from casing intake port 4. The downstream side is where the flow direction of the centrifugal airflow generated by centrifugal blower blade 8 ends.

As a result of the tilt, axial center 10 is tilted in the direction of tangent 15 to tongue portion 14 within the shortest distance from base point 31 of the tilt of axial center 10, and tilting angle 32 of axial center 10 ranges from 3 degrees or higher to 10 degrees or lower. When casing discharge port 5 is viewed from the front side as illustrated in FIG. 2, axial center 10 is tilted such that at least a part of side end part 16 of centrifugal blower blade 8 on the side of the blade intake port is exposed from casing discharge port 5.

Of a group of blades having multiple blades on the circumferential side of centrifugal blower blade 8, the blades on the side of blade intake port 7 constitute group of intake side blades 17 having high airflow properties when a static pressure is high, and the blades on the opposite side of blade intake port 7 constitute group of counter-intake side blades 18 having high airflow properties when the static pressure is low. Then, group of intake side blades 17 and group of counter-intake side blades 18 are combined. This configuration further improves the ventilation capability in a wide range of static pressure levels from high to low. As a result, the airflow properties and noise characteristics are further improved in a wide range of static pressure levels from low to high. An example of the high static pressure is at least 50 Pa, and an example of the low static pressure is at most 30 Pa. When the airflow properties are high, the ventilation is in good condition with a large airflow though the number of rotations of electric motor 9 remains unchanged.

Figure 4:
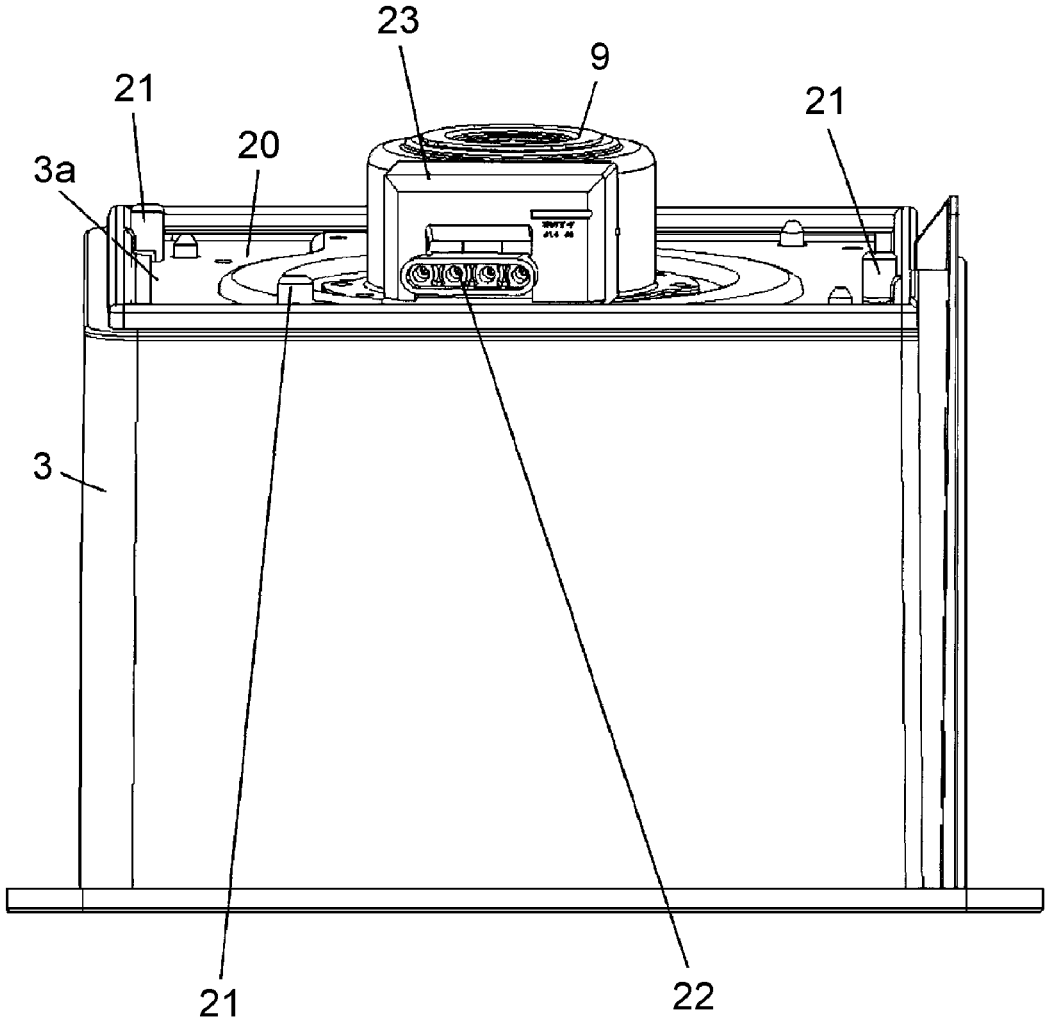
FIG. 4 is a side view of the ceiling-embedded ventilation fan viewed from the side of an insertion port of a power connector unit.
Figure 5:
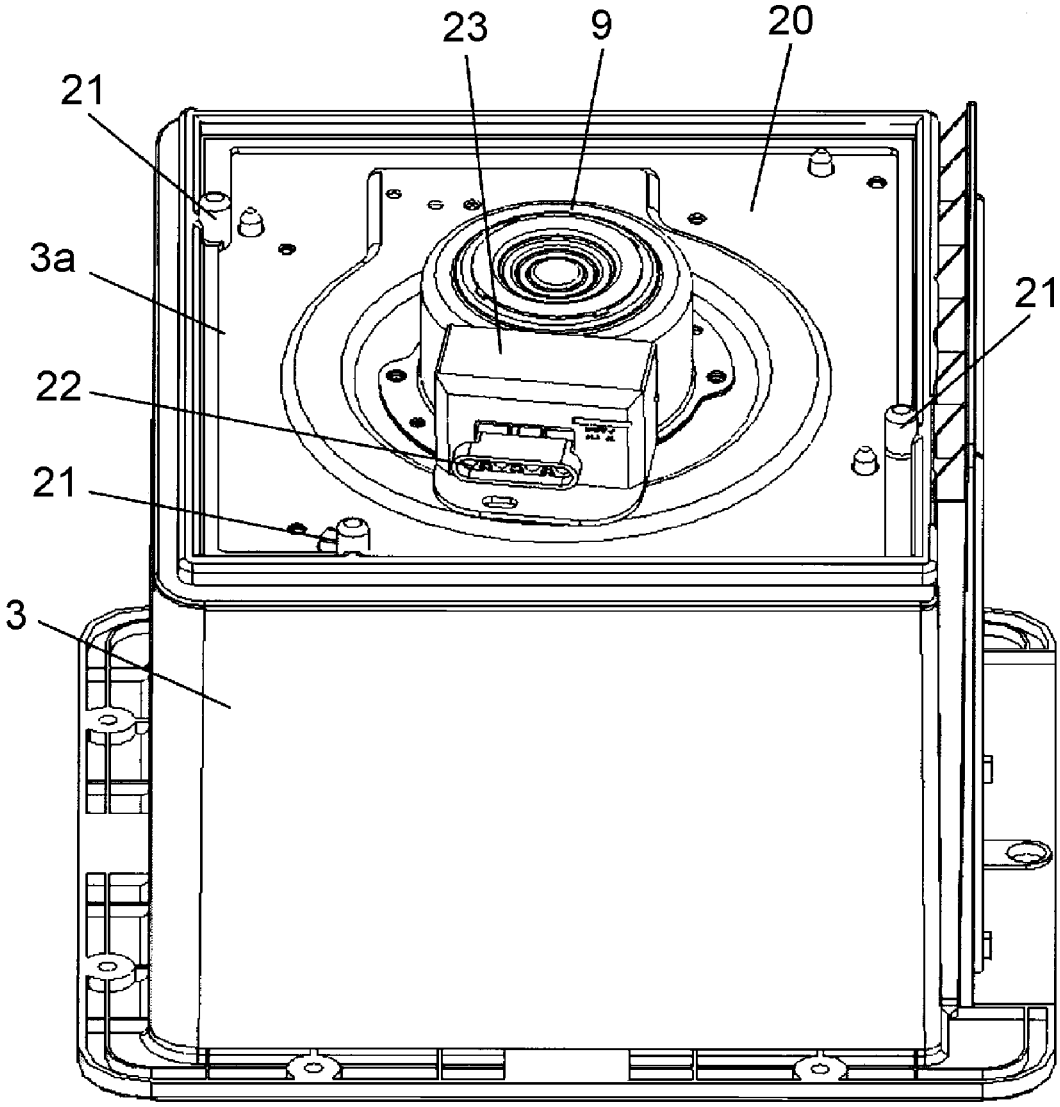
FIG. 5 is a perspective view of the ceiling-embedded ventilation fan viewed from the side of the power connector unit.

FIG. 4 is a side view of the ceiling-embedded ventilation fan according to Embodiment 1 of the present invention viewed from the side of an insertion port of a power connector unit. FIG. 5 is a perspective view of the ceiling-embedded ventilation fan viewed from the side of the power connector unit. As illustrated in FIGS. 4 and 5, electric motor 9 having centrifugal blower blade 8 secured thereto is mounted with a tilt so that centrifugal blower blade 8 is tilted and housed. To allow the structure, top face portion 3*a* of frame 3 is formed perpendicular to axial center 10 of centrifugal blower blade 8. Top face portion 3*a* is provided with electric motor mounting board 20 to which electric motor 9 is attached, and boss portions 21 respectively having threaded holes (not illustrated) into which locking screws (not illustrated) are screwed. The locking screws fixate casing 6 from the inside of frame 3. The threaded holes of boss portions 21 are vertically formed regardless of the tilt of top face portion 3*a*.

Power connector unit 23 for electrical continuity into which a power line is inserted through insertion port 22 is securely attached to electric motor mounting board 20 with insertion port 22 directed obliquely downward along the tilt of top face portion 3*a*.

A region on the downstream side of the centrifugal airflow based on center line 11 on an inner peripheral side of side face 6*a* has a large impact on the ventilation performance. According to the configuration described so far, an enlargement ratio of air course width B illustrated in FIG. 3, which is an increase ratio of a distance from a circumferential side face of centrifugal blower blade 8 on the discharge side to an inner peripheral side face of casing 6, increases from the side of blade intake port 7 to the opposite side of blade intake port 7. Accordingly, the enlargement ratio of the air course width is larger on the side of the blades opposite to blade intake port 7 than the other in the centrifugal blower wherein the mainstream of airflow is likely to flow toward the blades on the side of blade intake port 7. This helps the airflow be directed toward the blades on the opposite side of blade intake port 7, thereby improving the ventilation capability. As a result, the ventilation capability can be improved in all of the blades.

The center point in the longitudinal length of axial center 10 in centrifugal blower blade 8 is used as base point 31 of the tilt. This avoids an imbalance between an increase upward and a reduction downward in the enlargement ratio of air course width B of centrifugal blower blade 8. As a result, the fan can accomplish a good ventilation capability, generally, from when the static pressure is low in which case the mainstream of airflow mostly flows in the blades on the opposite side of blade intake port 7 to when the static pressure is high in which case the mainstream of airflow mostly flows in the blades on the side of blade intake port 7.

Axial center 10 is tilted in the direction of tangent 15 to tongue portion 14 within the shortest distance from base point 31 of the tilt, and tilting angle 32 of axial center 10 ranges from 3 degrees or higher to 10 degrees or lower. In consequence of the tilt, there is a substantially equal distance between the circumferential side face of centrifugal blower blade 8 on the discharge side and tongue portion 14 from the side of blade intake port 7 through to the opposite side of blade intake port 7. This prevents the development of any inverse vortex and interfacial layer which may be caused by a flaking incidental on the discharge-side circumferential side face of centrifugal blower blade 8 near tongue portion 14. Then, there is no risk of causing airflow turbulence in the entire area of tongue portion 14, or airflow vortex because of proximity of the discharge-side circumferential side face of centrifugal blower blade 8 to casing 6, thereby successfully increasing the airflow while avoiding any increase of the noise.

On the side of blade intake port 7 where the ventilation capability is better than the opposite side of blade intake port 7 when the static pressure is high, a larger part of the blades on the side of blade intake port 7 can be exposed from casing discharge port 5. Such an exposure of the blades leads to an improvement of the ventilation capability in casing discharge port 5 as well.

The blades on the side of blade intake port 7 and the blades on the opposite side of blade intake port 7 are suitably separated into different groups of blades, so that the ventilation capability can be improved in a wide range of static pressure levels from high to low.

Figure 6:
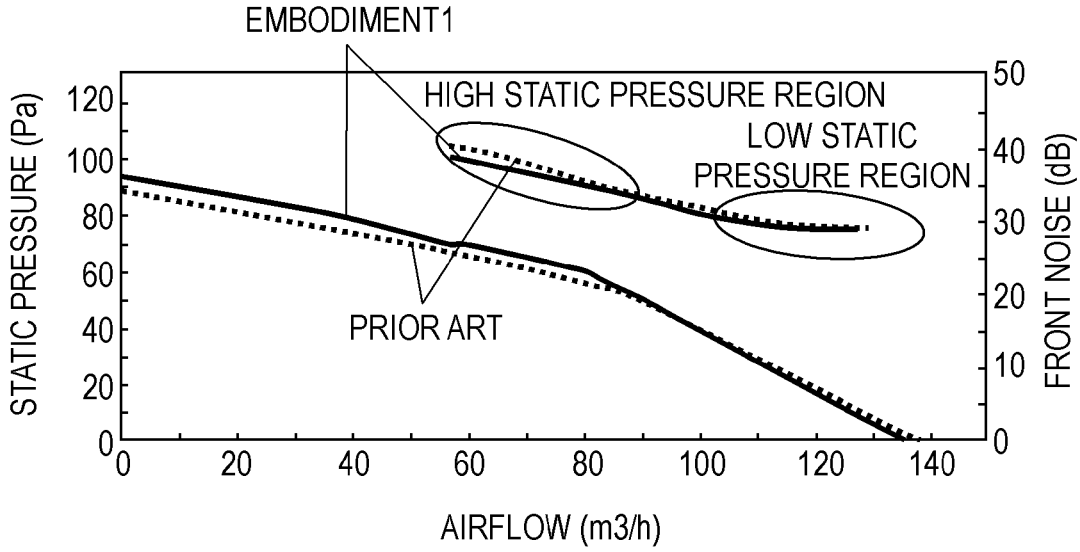
FIG. 6 is a graph illustrating airflow-static pressure characteristics of the ceiling-embedded ventilation fan and noise-static pressure characteristics on the front side of the fan.

As illustrated in FIG. 6 which is a graph of airflow-static pressure characteristics of the ceiling-embedded ventilation fan and noise-static pressure characteristics on the front side of the fan, the ceiling-embedded ventilation fan according to Embodiment 1 can improve the ventilation capability on the opposite side of blade intake port 7 when the static pressure is high, thereby increasing the airflow when the static pressure is high as compared to the prior art. The airflow can be thus increased without accelerating the rotation of centrifugal blower blade 8. Therefore, the fan can reduce a noise value and sustain airflow properties and noise characteristics when the static pressure is low.

Though top face portion 3*a* is tilted, the threaded holes are formed vertically downward. Because of the threaded holes thus formed, when the locking screws are fastened into the threaded holes to fixate electric motor mounting board 20 and casing 6 or removed therefrom during maintenance, a machining tool can be directed upward straight from the threaded holes during the operation, and the structural elements can be thereby easily attached and removed.

In such an event that raindrops through a leaky roof happen to contact the power line, the raindrops travel downward which is opposite to the direction of insertion port 22 away from power connector unit 23. Therefore, the risk of tracking can be avoided.

Embodiment 2

Figure 7:
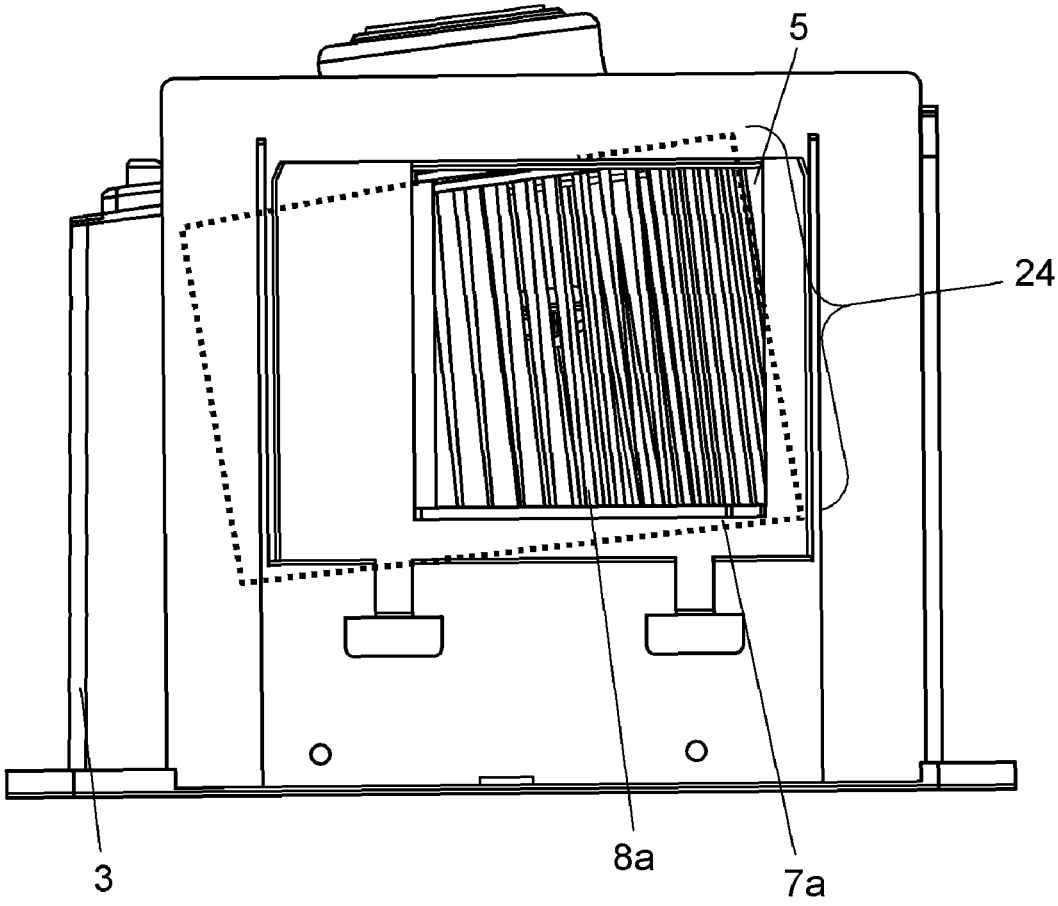
FIG. 7 is a side view of a ceiling-embedded ventilation fan according to Embodiment 2 of the present invention viewed from the side of a casing discharge port.

FIG. 7 is a side view of a ceiling-embedded ventilation fan according to Embodiment 2 of the present invention viewed from the side of a casing discharge port. There is the following difference between the ceiling-embedded ventilation fan according to Embodiment 2 and the ceiling-embedded ventilation fan according to Embodiment 1. Specifically, centrifugal blower blade 8*a* is different in that a group of blades having multiple blades on the circumferential side thereof is group of blades 24 of a single type for high static pressure having high airflow properties when the static pressure is high. Any other structural elements are the same as those according to Embodiment 1. These same structural elements are denoted by the same reference symbols and not described again.

In a centrifugal blower wherein the mainstream of airflow is likely to flow toward the blades on the side of blade intake port 7*a* when the static pressure is high, centrifugal blower blade 8*a* is provided with blades 24 of a single type for high static pressure having high airflow properties when the static pressure is high. Such a configuration further improves the ventilation capability when the static pressure is high, thereby contributing to further improvement of the airflow properties and noise characteristics when the static pressure is high.

Figure 8:
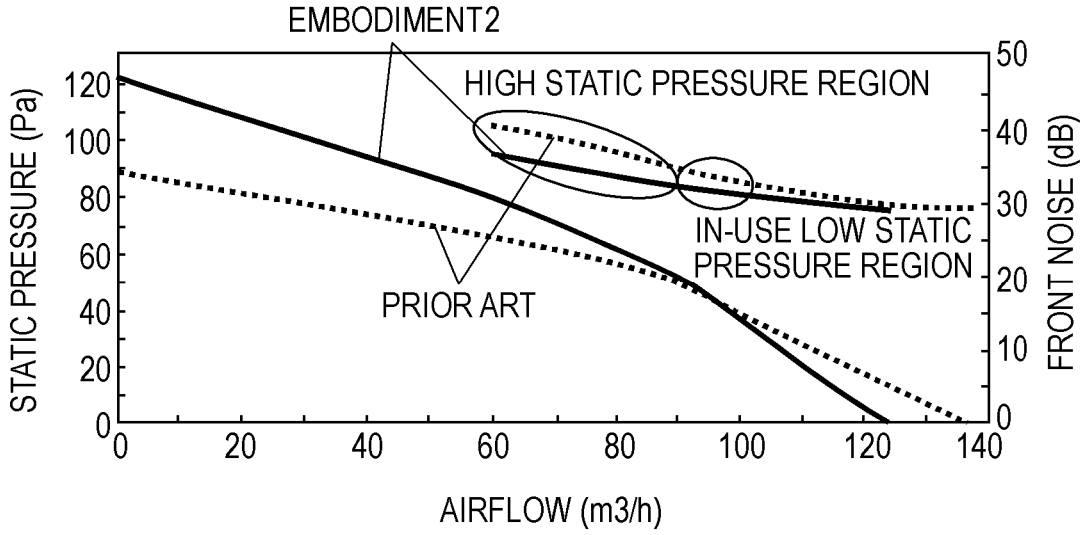
FIG. 8 is a graph illustrating airflow-static pressure characteristics of the ceiling-embedded ventilation fan and noise-static pressure characteristics on the front side of the fan.
Figure 9:
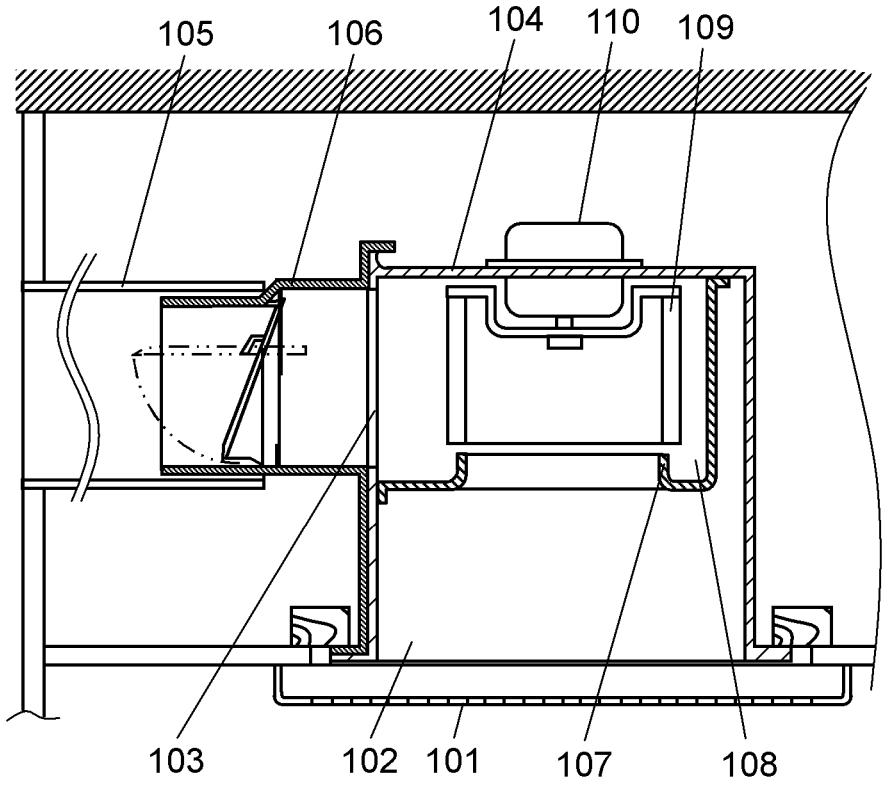
FIG. 9 PRIOR ART
FIG. 9 is a sectional view of a conventional ceiling-embedded ventilation fan mounted in a ceiling.

Furthermore, circumferential side face of group of blades 24 for high static pressure on the discharge side are substantially equally spaced in vicinity of tongue portion 14. This significantly improves the ventilation capability on the side of blade intake port 7*a*. FIG. 8 is a graph illustrating airflow-static pressure characteristics of the ceiling-embedded ventilation fan and noise-static pressure characteristics on the front side of the fan in Embodiment 2 of the present invention. As illustrated in FIG. 8, the airflow properties and noise characteristics are greatly improved in a high static pressure region.

Meanwhile, in the blades on the opposite side of blade intake port 7*a*, the enlargement ratio of the air course width increases, generating a smooth airflow on the opposite side of blade intake port 7*a* as well. As illustrated in FIG. 8, an expected airflow can be sustained with less noise as compared to the prior art in a part of the low static pressure region where the static pressure is at least a certain pressure level. In the ceiling-embedded ventilation fan connected to duct 1 laid in the ceiling for ventilation, a certain degree of resistance loss is generated after the fan is mounted in the ceiling. The state of the fan in use is illustrated in FIG. 8 as an in-use low static pressure region, and it can be observed from the illustration that the fan has no practical disadvantage.

As described so far, the ceiling-embedded ventilation fan according to Embodiment 2 of the present invention is particularly suitable for use focusing on high static pressures.

INDUSTRIAL APPLICABILITY

The present invention is applicable to a broad range of applications such as a ventilation device, a centrifugal blower, and an air conditioning device, which ventilate a room by way of a duct connected thereto.

REFERENCE MARKS IN THE DRAWINGS

1 Duct
2 Adapter
3 Frame
3*a* Top face portion
4 Casing intake port
5 Casing discharge port
6 Casing
6*a* Side face
7, 7*a* Blade intake port
8, 8*a* Centrifugal blower blade
9 Electric motor
10 Axial center
11 Center line
13 Opening
14 Tongue portion
15 Tangent
16 Side end portion on the side of blade intake port
17 A group of intake side blades
18 A group of counter-intake side blades
20 Electric motor mounting board
21 Boss portion
22 Insertion port
23 Power connector unit
24 A group of blades for high static pressure
30 Ceiling
31 Base point
32 Tilting angle

The invention claimed is:

1. A ceiling-embedded ventilation fan comprising:

a casing provided in a box-shape frame inserted and mounted in a ceiling and having an opening facing an indoor side in a lower face thereof, the casing having a side face formed in a scroll shape and set in a vertical direction, the casing further having a casing intake port in the lower face of the frame and a casing discharge port in a side portion of the frame;

a centrifugal blower blade housed in the casing and having a blade intake port facing the casing intake port; and an electric motor which rotates the centrifugal blower blade, wherein the centrifugal blower blade is provided so that an upper side of an axial center thereof is tilted in a direction toward an upstream side of a centrifugal airflow based on a center line of the casing intake port in a direction orthogonal to the casing discharge port.

2. The ceiling-embedded ventilation fan according to claim 1, wherein a center point in a longitudinal length of the centrifugal blower blade in the axial center is a base point of the tilt.

3. The ceiling-embedded ventilation fan according to claim 2, wherein the axial center is tilted in the direction of a tangent to a tongue portion within a minimum distance from the center point in the longitudinal length.

4. The ceiling-embedded ventilation fan according to claim 3, wherein the axial center is tilted such that at least a part of a side end part of the centrifugal blower blade on the side of the blade intake port is exposed from the casing discharge port when the casing discharge port is viewed from a front side of the fan.

5. The ceiling-embedded ventilation fan according to claim 3, wherein a tilting angle of the axial center ranges from 3 degrees or higher to 10 degrees or lower.

6. The ceiling-embedded ventilation fan according to claim 1, wherein, of a group of blades having multiple blades on a circumferential side of the centrifugal blower blade, the blades on the side of the blade intake port constitute a group of intake side blades having high airflow properties when a static pressure is high, and the blades on the opposite side of the blade intake port constitute a group of counter-intake side blades having high airflow properties when the static pressure is low, and the group of intake side blades and the group of counter-intake side blades are combined.

7. The ceiling-embedded ventilation fan according to claim 1, wherein a group of blades having multiple blades on a circumferential side of the centrifugal blower blade is a group of blades of a single type for high static pressure having high airflow properties when the static pressure is high.

8. The ceiling-embedded ventilation fan according to claim 1, wherein a top face portion of the frame formed on a face perpendicular to the axial center is provided with an electric motor mounting board to which the electric motor is attached, and boss portions respectively having threaded holes into which locking screws for fixating the casing are screwed, and the threaded holes are vertically formed.

9. The ceiling-embedded ventilation fan according to claim 8, wherein a power connector unit for electrical continuity into which a power line is inserted through an insertion port is securely attached to the electric motor mounting board with the insertion port directed obliquely downward.

* * * * *